United States Patent [19]

Hirose et al.

[11] Patent Number: 4,823,755

[45] Date of Patent: Apr. 25, 1989

[54] FUEL INJECTION SYSTEM FOR AN INTERNAL COMBUSTION ENGINE

[75] Inventors: Katsuhiko Hirose, Susono; Hiroshi Noguchi, Gotenba; Toyokazu Baika, Susono; Kingo Horii, Susono; Hideo Nagaosa, Susono; Toshio Tanahashi, Susono; Toshio Itoh, Susono, all of Japan

[73] Assignee: Toyota Jidosha Kabushiki Kaisha, Japan

[21] Appl. No.: 137,528

[22] Filed: Dec. 23, 1987

[30] Foreign Application Priority Data

| | | | |
|---|---|---|---|
| Jan. 27, 1987 | [JP] | Japan | 62-015101 |
| Jan. 27, 1987 | [JP] | Japan | 62-015102 |
| Jan. 27, 1987 | [JP] | Japan | 62-015103 |
| Jan. 27, 1987 | [JP] | Japan | 62-015104 |
| Jan. 27, 1987 | [JP] | Japan | 62-015105 |
| Jan. 27, 1987 | [JP] | Japan | 62-015106 |

[51] Int. Cl.[4] ..... F02D 41/26; F02M 51/00

[52] U.S. Cl. ..... 123/480; 123/486; 123/494; 123/73 C

[58] Field of Search ..... 123/73 C, 302, 65 BA, 123/65 VD, 316, 90.16, 478, 480, 486, 488, 491, 494

[56] References Cited

U.S. PATENT DOCUMENTS

| | | | |
|---|---|---|---|
| 4,162,662 | 7/1979 | Melchoir | 123/65 VD |
| 4,224,905 | 9/1980 | von Seggern et al. | 123/65 WA |
| 4,357,917 | 11/1982 | Aoyama | 123/90.16 |
| 4,543,928 | 11/1985 | von Seggern | 123/262 |
| 4,548,175 | 10/1985 | Kawai et al. | 123/308 |
| 4,683,539 | 7/1987 | Kanno et al. | 123/494 X |
| 4,702,214 | 10/1987 | Wataya | 123/486 X |
| 4,706,631 | 11/1987 | Wataya | 123/486 X |
| 4,716,876 | 1/1988 | Shimomura et al. | 123/494 X |
| 4,732,116 | 3/1988 | Tanahashi et al. | 123/65 BA |
| 4,732,117 | 3/1988 | Tanahasi et al. | 123/65 PE |
| 4,732,118 | 3/1988 | Tanahashi et al. | 123/65 VD |
| 4,732,124 | 3/1988 | Nakamura et al. | 123/302 |

FOREIGN PATENT DOCUMENTS 0027731 3/1978 Japan .

*Primary Examiner*—Willis R. Wolfe

*Attorney, Agent, or Firm*—Parkhurst, Oliff & Berridge

[57] ABSTRACT

In a two stroke fuel injection type internal combustion engine provided with intake and exhaust valves, a basic amount of fuel to be injected is calculated in accordance with an engine load and engine speed. Values of a factor corresponding to a ratio of air captured by an engine cylinder for combustion to the total amount of air introduced into the engine are stored in a memory in accordance with combinations of an engine load and engine speed. A value of a captured air factor corresponding to a detected combination of an engine load and speed is calculated by a map interpolation. The basic amount is corrected by the captured air factor so that a desired air-fuel ratio is obtained. The captured air factor may be further corrected in accordance with a secondary engine condition, other than an engine load and speed, such as a cooling water temperature, intake air temperature, atmospheric air temperature, atmospheric air pressure, exhaust gas temperature, or intake pressure.

20 Claims, 20 Drawing Sheets

EXHAUST
(EX)
P

WEAK EXHAUST
BLOW-DOWN
EX

INTAKE
(F)
EX
Q
R

REVERSED EXHAUST GAS SWIRL
ABOUT VERTICAL AXIS
EX

EX
F
S
R

INTRODUCTION OF
NEW AIR
EX
Fa

EX
F
S
R

STRATIFICATION AS
MAINTAINED
EX
Fa

F

PREVENTION OF
RETURN BLOW
Fa

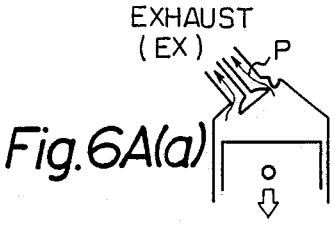
Fig.6A(a)
STRONG EXHAUST BLOW-DOWN
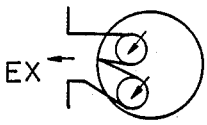
Fig.6B(a)
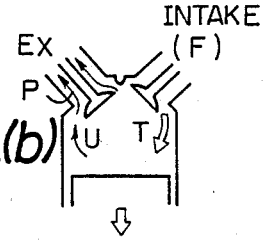
Fig.6A(b)
START TRANSVERSE SCAVENGING
Fig.6B(b)
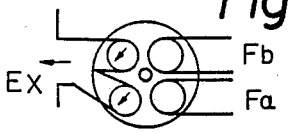
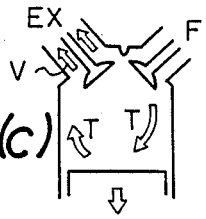
Fig.6A(c)
CONTINUE TRANSVERSE SCAVENGING
Fig.6B(c)
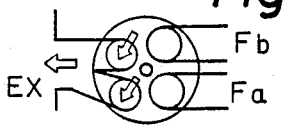
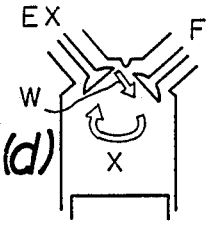
Fig.6A(d)
REVERSED BLOWN-OUT AIR SWIRL
Fig.6B(d)
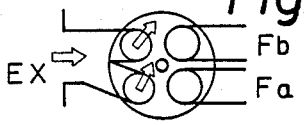
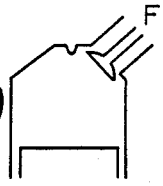
Fig.6A(e)
PREVENT NEW AIR TO RETURN BLOW
Fig.6B(e)
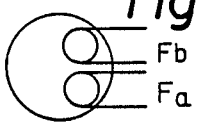

| Fig. 8A | Fig. 8B |
|---|---|

—— ACTUAL CHANGE OF $f_{TR}$

—·— CONTRIBUTION BY OPERATION OF INTAKE CONTROL VALVE

---- NO AFFECT OF EXHAUST PRESSURE

| Fig. 10A | Fig. 10B |
|---|---|

| Fig.11A | Fig.11B |
|---|---|

| Fig.12A | Fig.12B |
|---|---|

| Fig. 13 A | Fig. 13 B |
|---|---|

| Fig.14A | Fig.14B |
|---|---|

FUEL INJECTION SYSTEM FOR AN INTERNAL COMBUSTION ENGINE

BACKGROUND OF THE INVENTION

1. Field of the Invention

The present invention relates to a fuel injection system for a two stroke internal combustion engine. The present invention may be also applied for a two stroke engine having 4 valves wherein a large amount of air is blown out due to a long valve overlap period in which both the intake and exhaust valves are open.

2. Description of the Related Art

In a two stroke engine, a long period occurs in one engine cycle wherein both intake and exhaust ports are open. During this long period, a large amount of fuel is blown out to the exhaust pipe before being combusted in the cylinder bore, when the fuel is introduced into the cylinder bore in the form of a combustible mixture from a carburetor in the usual way, and this blowing out of fuel reduces the fuel consumption efficiency. Therefore, a system was proposed wherein a fuel injector supplies a calculated amount of fuel to the engine at a predetermined period so that the fuel will be effectively combusted in the cylinder bore. The blowing of air to the exhaust pipe before combustion is, however, inevitable regardless of the fuel injection system used. Namely, only a part of the total amount of air introduced into the cylinder bore is actually combusted, and therefore, the amount of fuel to be injected from the injectors is calculated from an amount of air as sensed, multiplied an air-capturing ratio which corresponds to the ratio of the amount of air captured in the cylinder bore for combustion to the total amount of air, so that the combustible mixture in the cylinder bore actually combusted becomes equal to a predetermined air fuel ratio required for the combustion operation. This captured air ratio, however, has different values, which are obtained in accordance with the engine basic operating conditions including an engine load and speed.

To obtain a desired air fuel-ratio value regardless of whether or not the captured air ratio is varied in accordance with engine load and speed, an improved system has been proposed wherein the basic fuel amount as calculated is corrected in accordance with the captured air ratio, which is calculated in accordance with an engine load and speed. See Japanese Unexamined Patent Publication No. 53-27731. In this prior art, the correction factor is calculated in accordance with an engine load and speed by using an algebraic function, such as an exponential function. In other words, a change of value in the captured air ratio is approximated to an exponential function, and this function is used to determine the captured air ratio for calculating the corrected amount of fuel to be injected.

This prior art is based on the concept that the captured air ratio changes in accordance with engine operating conditions along an exponential function. However, the actual captured air ratio in a two stroke engine has a complicated characteristic, since it is not only affected by the basic factors, i.e., engine load and speed, as usual, but also affected by a particular factor in a two cycle engine, i.e., a blow down of the exhaust gas. Therefore, a precise correction of the blown out air by a mere approximation using an exponential function is very difficult, and thus a precise control of air fuel ratio in accordance with the captured air ratio cannot be realized. Accordingly, it becomes impossible to obtain a desired air-fuel ratio, thus lowering the fuel consumption efficiency and causing an excessive increase in the temperature of the catalytic converter.

SUMMARY OF THE INVENTION

An object of the present invention is to provide a system capable of obtaining a desired air-fuel ratio by precisely correcting the captured air ratio, the change of which in accordance with engine operating conditions is very complex.

According to the present invention, there is provided an internal combustion engine comprising:

an engine body;

an intake system connected to the engine body for an introduction of air thereto;

an exhaust system connected to the engine body for a removal of a resultant exhaust gas;

means for supplying a desired amount of fuel to the engine;

means for calculating the desired amount of fuel in accordance with engine operating conditions, including an engine load and engine speed;

map means for storing data of a parameter for compensation of the amount of air to be blown out, this map comprising a plurality of values of the parameter, and each value being determined by a combination of engine load and engine speed;

means for detecting a combination of an engine load and engine speed;

means for interpolating a value of the parameter corresponding the combination detected;

means for correcting the calculated fuel amount by incorporating the calculated parameter, and;

means for generating a signal directed to the fuel supply means for an introduction of a corrected amount of fuel into the engine.

BRIEF DESCRIPTION OF THE DRAWINGS

FIGS. 6A(*a*) to 6A(*e*) are schematic vertical sectional views of a cylinder according to the present invention at respective piston positions as shown, when the engine is under a high load condition;

FIGS. 6B(*a*) to 6B(*e*) are schematic horizontal cross sectional plan views of a cylinder at various piston positions corresponding to FIGS. 6A(*a*) to 6A(*e*), respectively;

DESCRIPTION OF THE PREFERRED EMBODIMENTS

Figure 1:
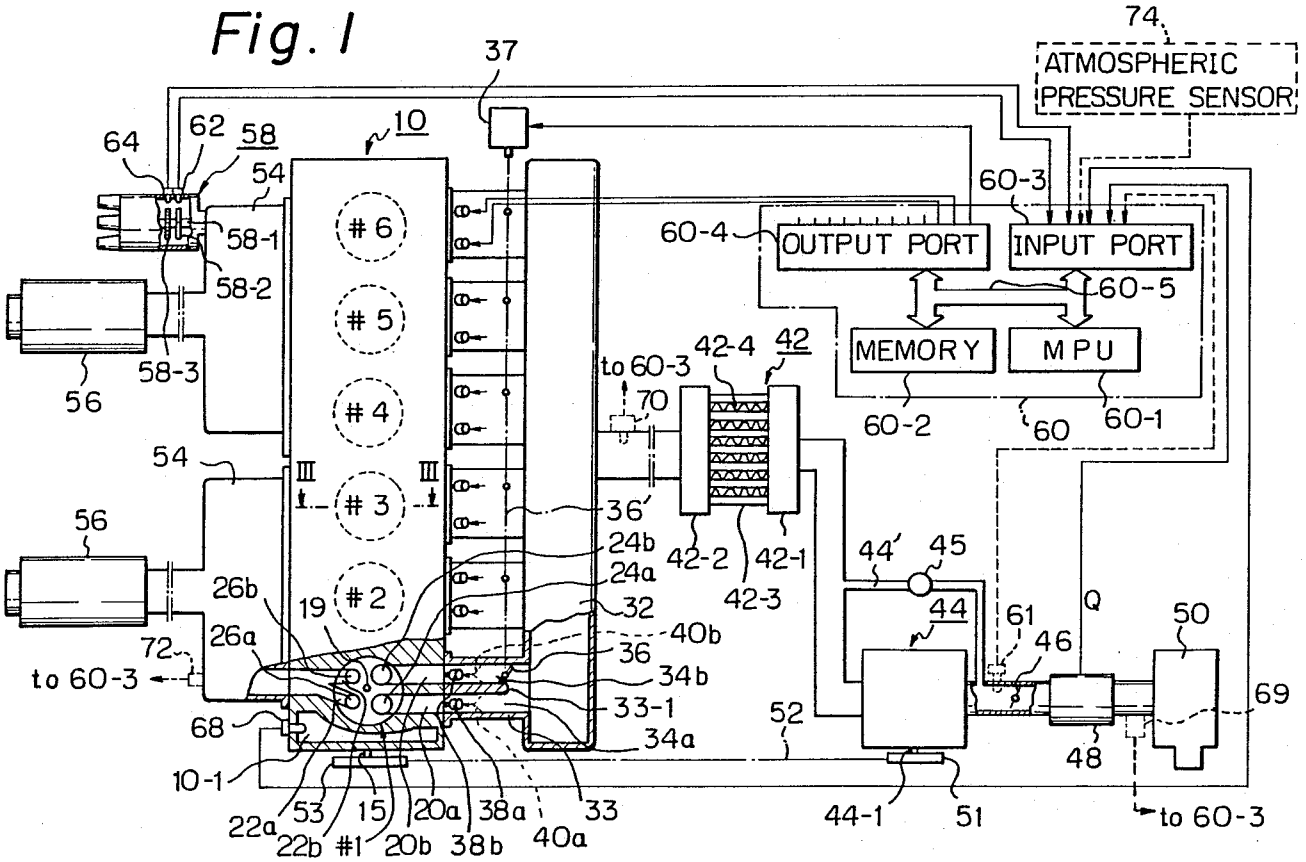
FIG. 1 is a schematic view of an entire engine system according to the present invention.

FIG. 1 shows a two stroke internal combustion engine having 6 cylinders provided with intake and exhaust valves, to which the present invention is applied. As described later, in this type of two stroke engine, after a blow-down, a flow of exhaust gas returned to the cylinder bore occurs to generate a swirl movement of the exhaust gas therein, allowing a stratification to be realized in order to concentrate newly inducted air at a portion adjacent to a spark gap at the upper portion of the combustion chamber, so that the combustible mixture is easily ignited when the engine is under a low load condition. This invention, however, is not limited to the above type of two stroke engine, and can be also applied to a usual piston valve type two stroke internal combustion engine. The present invention also can be applied to a four stroke engine having a long valve overlap period, wherein both intake and exhaust valves are opened and thus a large amount of air is blown out to the exhaust system before being combusted in the cylinder bore.

Figure 2:
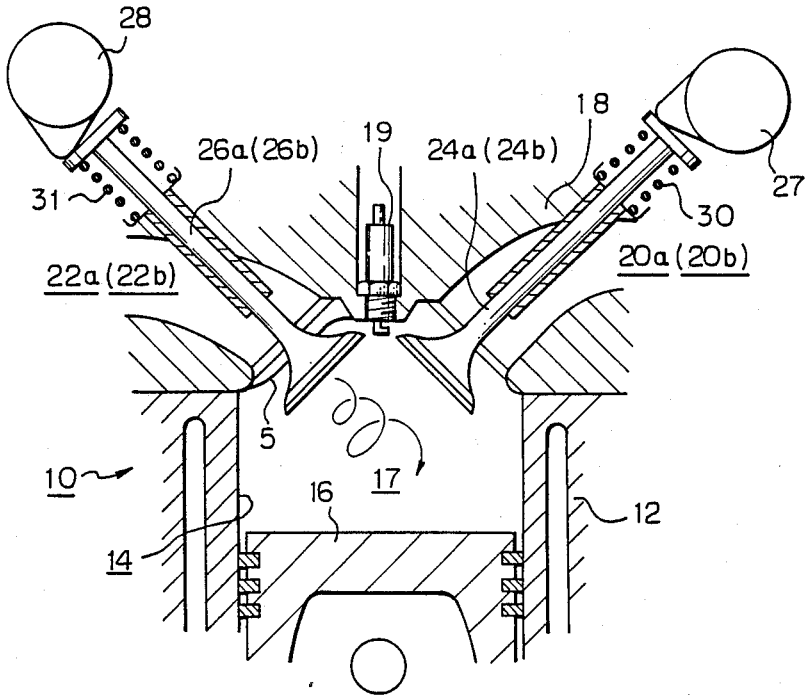
FIG. 2 is a vertical cross sectional view of a cylinder of the engine in FIG. 1, taken along a line III—III.
Figures 10, 10A:
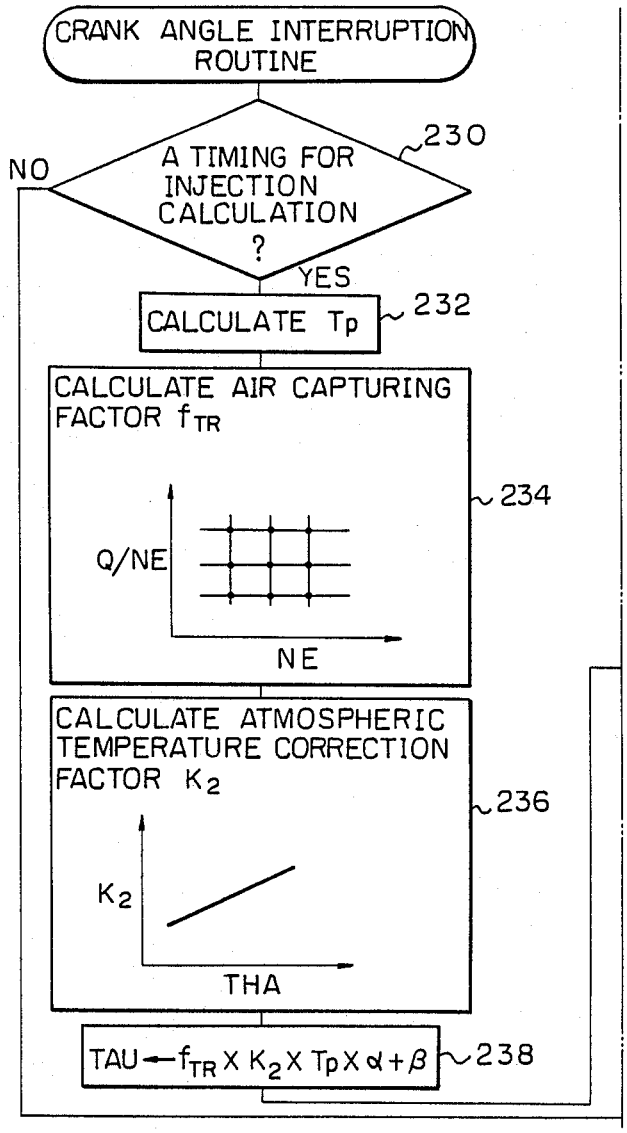
Figure 10B:
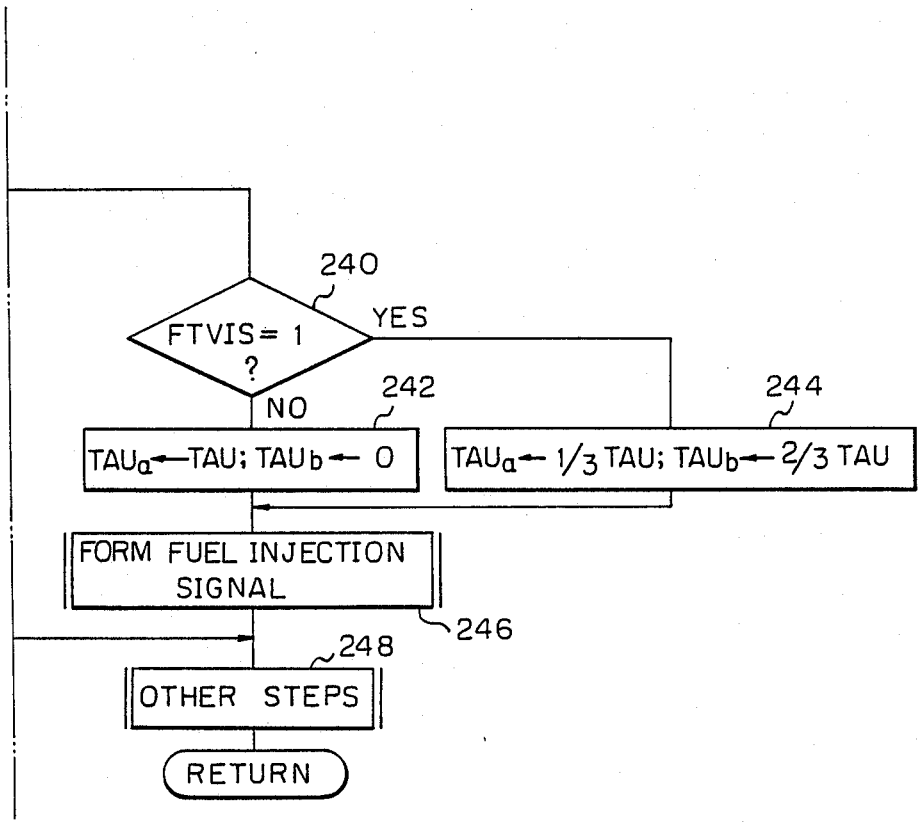

In FIGS. 1 and 2, 10 designates an engine body, which comprises a cylinder block 12, cylinder bore 14, crankshaft 15, piston 16, combustion chamber 17, cylinder head 18, and spark plug 19. The cylinder head 18 is provided with two intake ports 20*a* and 20*b*, and two exhaust ports 22*a* and 22*b* at each of the cylinders, and intake valves 24*a* and 24*b* and exhaust valves 26*a* and 26*b* are provided for selectively opening and closing these ports 20*a*, 20*b* and 22*a*, 22*b*. The intake valves 24*a*, 24*b* and exhaust valves 26*a*, 26*b* are operated by cams 27 and 28 (FIG. 2), respectively. Reference numerals 30 and 30 denote valve springs. The exhaust ports 22*a* and 22*b* are so formed that a swirl motion of exhaust gas about a substantially vertical axis is generated in the cylinder bore when exhaust gas remaining in the exhaust port after blow-down flows back into the cylinder bore.

Also, in FIG. 1, 32 designates a surge tank connected to intake pipes 33 connected to the respective cylinders. Each intake pipe 33 is provided with an inner partition 33-1 defining two intake passageways 34*a* and 34*b* in the intake pipe 33 which are connected to the intake ports 20*a* and 20*b*, respectively. The second intake port 20*b* has an effective dimension larger than that of the first intake port 20*a*. An intake control valve 36 is arranged in the second intake passageway 34*b*, and this intake control valve 36 is operatively connected, via a link mechanism 36', to an actuator 37. The actuator 37 is, for example, a vacuum operated diaphragm mechanism, and is selectively connected to a vacuum source or atmosphere by a switching valve (not shown), so that the intake control valve 36 is selectively moved between a position at which the second passageway 34*a* is open and a position at which the second passageway 34*a* is closed. As explained later, the control valve 36 is opened when the engine load is high, and is closed when the engine load is low. Injectors 38*a* and 38*b* are arranged in the intake passageways 34*a* and 34*b*, respectively, and reed valves 40*a* and 40*b* are also provided in the passageways 34*a* and 34*b*, respectively for control of the back flow.

Arranged in the air intake line upstream from the surge tank 32 are an inter-cooler 42, a mechanical supercharger 44, a throttle valve 46, an air flow meter 48, and an air cleaner 50. The mechanical supercharger 44 is, for example, a Roots type pump or vane type pump, having a drive shaft 44-1 on which a pulley 51 is mounted. The pulley 51 is connected, via a belt 52, to a pulley 53 on the crankshaft 15 of the engine for rotating the supercharger 44. A by-pass passageway 44' is connected to the air intake line, to by-pass the supercharger 44, and a by-pass control valve 45 is arranged on the by-pass passageway 44' for controlling the pressure in the air intake line at a position located between the supercharger 44 and the throttle valve 46. The intercooler is an air cooled type, having an input tank 42-1, output tank 42-2, heat exchanger pipes 42-3 connecting these tanks 42-1 and 42-2, and fins 42-4 arranged on the pipes 42-3.

In this embodiment, exhaust manifolds 54 are separately provided for a first group comprising the first to third cylinders and a second group comprising the fourth to sixth cylinders. The grouping is such that two consecutive ignition cycles occur alternately between the first and the second group of cylinders. Note, the ignition cycle is in the order of first, sixth, second, fourth, third, and fifth cylinders. This grouping of the cylinders connected to separate exhaust manifolds 54 prevents any affect on the exhaust pressure at one cylinder in an exhaust cycle by the pressure at exhaust ports of the remaining cylinders. The exhaust manifolds 54 for cylinders 1 to 3 and for cylinders 4 to 6 are connected respectively to separate catalytic converters 56. The catalytic converters 56 operate as a muffler in this embodiment, but separate mufflers may be also provided.

Reference numeral 58 denotes a distributor is connected to spark plugs 19 of the respective cylinders. The distributor 58 is connected to the spark plugs 19 via an ignition coil and ignitor (not shown) in a known manner so that ignition at each cylinder takes place at a calculated crank angle timing.

According to the present invention, a control circuit 60 is a microcomputer system controlling the injectors 38*a* and 38*b* so that the desired air-fuel ratio values are obtained. The control circuit 60 is provided with a micro-processing unit (MPU) 60-1, a memory 60-2, an input port 60-3, an output port 60-4, and a bus 60-5 interconnecting these elements. The input port 60-3 is connected to various sensors for detecting the engine operating conditions; for example, to a volume measuring type air flow meter 48 measuring the volumetric intake air amount Q passing through the air intake line. The present invention also may be applied to a fuel injection system where an intake pressure sensor is provided instead of the air flow meter 18. In the latter case, a semiconductor type intake pressure sensor 61 is arranged in the air intake line downstream of the throttle valve 46 and upstream of the supercharger 44. Since this system is provided with a by-pass passageway 44', the intake pressure sensor 61 is preferably located upstream of the by-pass passageway 44', so that the value of the intake air pressure is not affected by the amount of by-pass air passing through the passageway 44'. When the engine is not provided with a by-pass passageway, the intake pressure sensor 61 may be arranged downstream of the supercharger 44.

Crank angle sensors 62 and 64, which are Hall elements, are arranged on the distributor 58. The first crank angle sensor 62 faces a magnet member 58-1 on a distributor shaft 58-1, so that a reference pulse signal is generated for every 360 degrees of crank angle; corresponding to one cycle of a two stroke engine. The second crank angle sensor 64 faces a magnet member 58-3, so that a pulse signal is generated for every 30 degrees of crank angle. This pulse signal is used for detecting an engine speed and for commencing a fuel injection routine. A temperature sensor 68 is mounted on the cylinder block 10 for detecting a temperature of the engine cooling water in a water jacket 10-1.

The MPU 60-1 executes routines in accordance with programs and data stored in the memory 60-2, to output signals to the actuator 37 and injectors **38*a* and 38*b* through the output port 60-4**.

Figure 3:
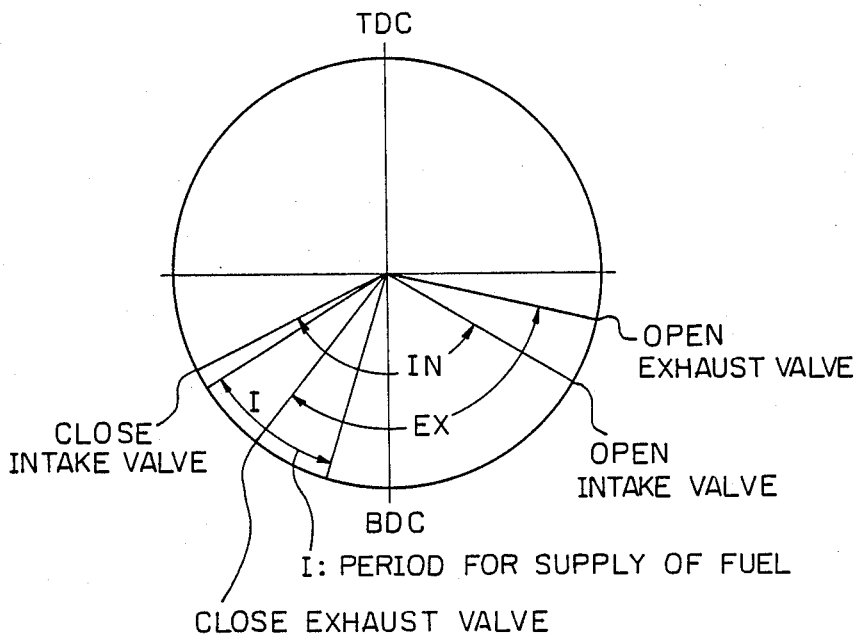
FIG. 3 is a diagrammatic chart illustrating the operations of intake and exhaust valves in a cylinder.

FIG. 3 illustrates the operation timings of each of the intake valves **24*a* and 24*b* and exhaust valves 26*a* and 26*b*, determined by the profile and angular position thereof. During the stroke of a piston 16 from a top dead center TDC thereof, the exhaust valves 26*a* and 26*b* first open at a position 80 degrees before a bottom dead center BDC, and the intake valves 24*a* and 24*b* begin to open at a position 60 degrees before BDC. The exhaust valves 26*a* and 26*b* close at a position 40 degrees after BDC, and finally, the intake valves 24*a* and 24*b* close at a position 60 degrees after BDC. The periods for which the intake valves 24*a*, 24*b* and exhaust valves 26*a*, 26*b* are open are indicated by IN and EX, respectively. The period for which the fuel injection is carried out is indicated by I, and is determined so that the fuel injection is terminated at least by the time the intake valves 24*a* and 24*b*** are fully closed.

Figure 4:
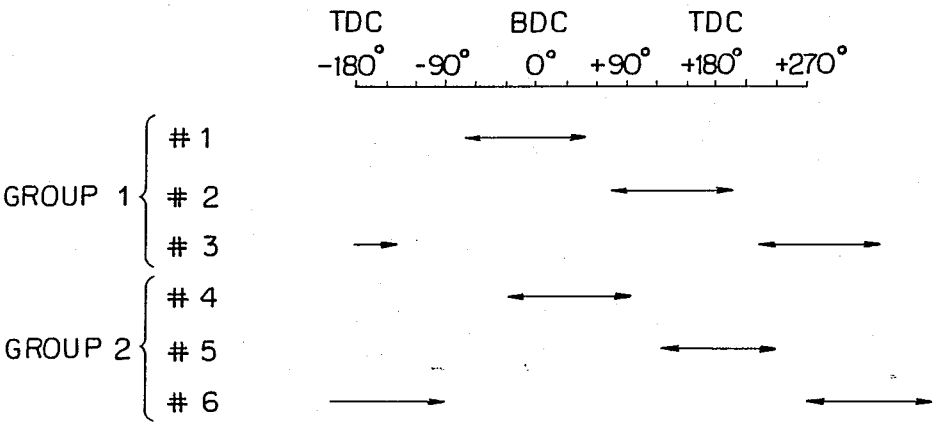
FIG. 4 is a diagrammatic chart illustrating the operations of exhaust valves of the respective cylinders.

FIG. 4 indicates the period at each of the cylinders for which the exhaust valves **26*a* and 26*b* are open. Since the engine is a two stroke type, one cycle of the engine is completed by a 360 degrees of crank angle. The exhaust valves 26*a*, 26*b* of the respective cylinders are open for a period designated by solid lines, with arrows showing the order of ignition. At the cylinders in each of the first and second groups (1 to 3 and 4 to 6), between which the ingition cycle alternately occurs, the exhaust valves 26*a* and 26*b* open at every 120 degrees of crank angle, and the period of the exhaust cycle is smaller than 120 degrees. This means that, in each of the first and second groups, there is no overlap of the exhaust periods, and as a result, the exhaust pressure in one cylinder now under ignition does not affect the exhaust pressure in a cylinder at which the subsequent ignition will occur in each group, even though the exhaust ports 26*a*, 26*b* are connected to the exhaust manifold 54 common to each respective group. A pulse will occur in the exhaust gas pressure after the blow-down, and the exhaust gas pressure after the blow-down determines the amount of blown out intake air for which compensation must be made to maintain a desired air-fuel ratio, in accordance with the present invention. This pressure of the exhaust port at which the blown out occurs is affected by the pressure in an exhaust port of a cylinder at which a following ignition occurs, if the former and the latter exhaust ports are connected with each other, causing an unpredictably change in the amount of blown out air, so that a precise compensation of the blown out air, which is the object of the present invention, become impossible. The grouping of the cylinders according to the present invention prevents any affect on the exhaust pressure by the exhaust pressure at the subsequent ignition. Note, there are periods of overlap of the opening of the exhaust valves 26*a* and 26*b* between the first and second groups, but this does not cause a mutual influence of exhaust pressure between the two groups, since the two group of cylinders are connected to different exhaust manifolds 54**.

The principle of the combustion operation of a two stroke engine provided with intake and exhaust valves according to the present invention will now be described. When the engine is under a low load, the intake control valve 36 is closed, so that the introduction of air is made only via the first passageway **34*a*. During the downward movement of the piston 16, the exhaust valves 26*a* and 26*b* first begin to move at a crank angle of about 80 degrees before BDC. As a result, a "blow down" occurs wherein the exhaust gas from the combustion chamber 17 flows into the exhaust ports 22*a* and 22*b*, as shown by arrows P in FIG. 5A(*a*) and FIG. 5B(*a*), but, since the engine load is low, this blow down is weak and soon finished. Note, the pressure level in the exhaust ports 22*a* and 22*b*** is not affected by the exhaust pressure at the cylinder in which the following ignition occurs, since the latter cylinder belongs to a different group to that of the first cylinder.

Figures 5A, 5B:
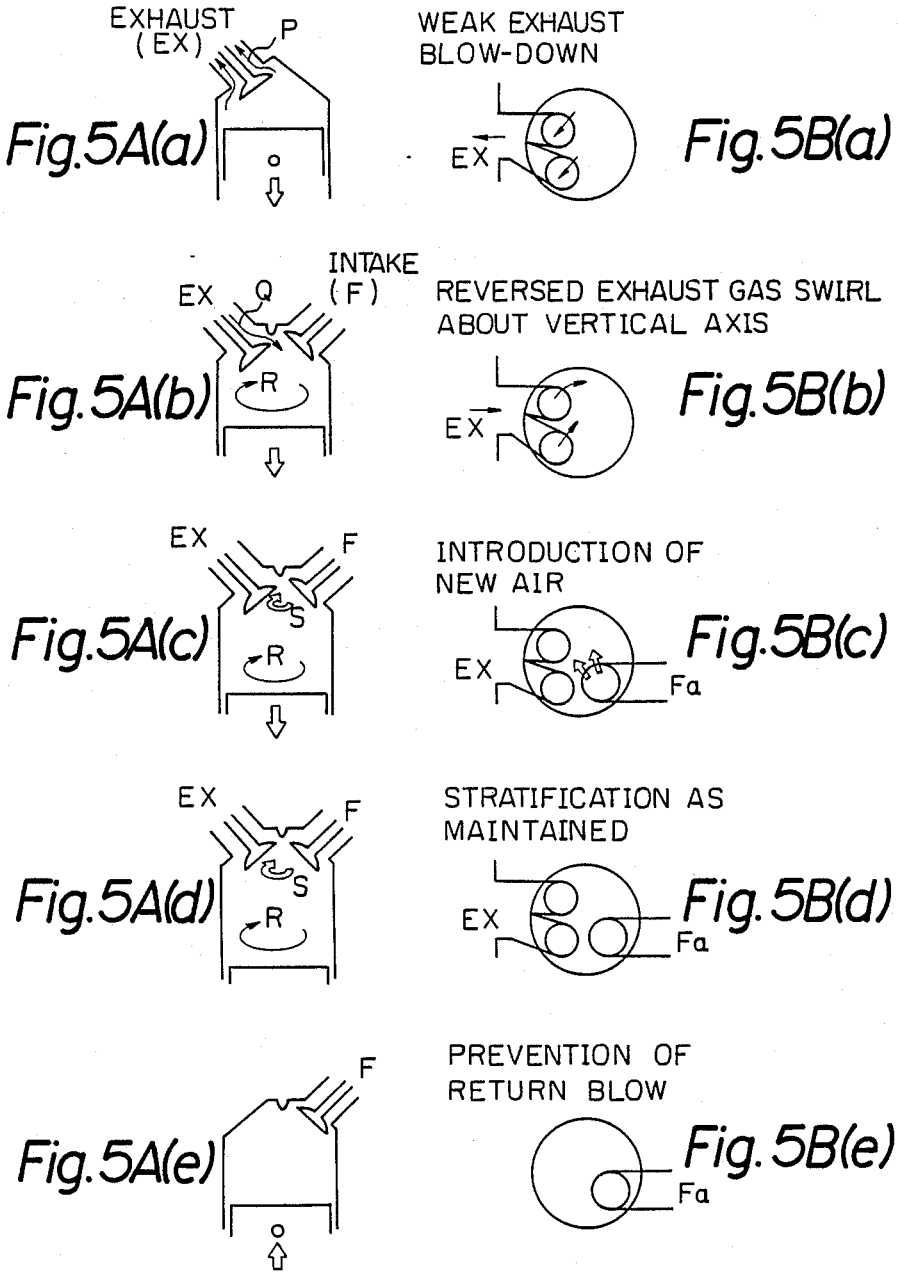
FIGS. 5A(*a*) to 5A(*e*) are schematic vertical sectional views of a cylinder according to the present invention, at the respective piston positions as shown, when the engine is under a low load condition.
FIGS. 5B(*a*) to 5B(*e*) are schematic horizontal plan views of a cylinder at various piston positions, corresponding to FIGS. 5A(*a*) to 5A(*e*), respectively.

During the further downward stroke of the piston 16, a weak vacuum pressure occurs in the cylinder bore 14, so that a pressure difference is created between the exhaust ports **22*a* and 22*b*, causing the exhaust gas to flow back into the cylinder bore 14 as shown by an arrow Q in FIG. 5A(*b*) and FIG. 5B(*b*). A swirl motion is generated in this back flow of exhaust gas, as shown by an arrow R, due to the arrangement of the exhaust ports 26*a* and 26*b*. At this time the intake valves 24*a* and 24*b* commence to open, but substantially no intake air is introduced because of the small lift of the intake valves, the small degree of opening of the throttle valve 46, and because the intake control valve 36 is closed to close the larger passageway 34*b* and thus allow an introduction of air via only the first passageway 34*a*** having a small effective area.

As the piston 16 descends further, the swirl motion of the exhaust gas is continued while a substantial introduction of air into the cylinder bore, as shown by an arrow S (FIG. **5A(*c*) and FIG. 5B(*c*), is commenced because the intake valves 24*a* and 24*b* have an increased lift. In this case, a stratification is realized wherein the swirled exhaust gas is moved lower in the cylinder bore while newly introduced air mixed with the injected fuel is moved to a position adjacent to the electrodes and above the swirled exhaust gas, as shown by FIGS. 5A(*c*) and 5B(*c*). FIGS. 5A(*d*) and 5B(*d*) show that this stratified condition of the exhaust gas R and the newly introduced air S is maintained when the piston reaches bottom dead center (BDC). At the position of the piston shown in FIGS. 5A(*e*) and 5B(*e*), the intake valves 24*a* and 24*b* are closed to prevent a blow back of the newly introduced air into the intake port. Then the piston is moved upward while the above mentioned stratified condition of the exhaust gas and the newly introduced air is maintained, until the compression stroke is completed, so that the combustible mixture located near the electrode 19-1 (FIG. 2**) can be easily ignited.

When the engine is under a high load, the intake control valve 36 is opened so as to open the large dimension intake passageway **34*b*. In FIGS. 6A(*a*) and 6B(*a*), when the exhaust valves 26*a* and 26*b* are opened during the downward movement of the piston 16, a blow-down occurs whereby the exhaust gas in the cylinder bore 14 is rapidly sent to the exhaust ports 22*a* and 22*b*, as shown by an arrow P. The degree of blow-down during a high load is stronger and longer than that in a low load, and therefore, a large amount of exhaust gas is exhausted into the exhaust ports 22***a*, 22*b*. At the position of the piston shown in FIGS. 6A(*b*) and 6B(*b*), the intake valves 24*a* and 24*b* commence to open, which allows the introduction of a substantial amount of new air, as shown by an arrow T, because the degree of opening of the throttle valve 46 is large, the intake control valve 36 is open position to open the larger passageway 34*b* and allow the introduction of air via both the first and second passageways 34*a* and 34*b*, and a sufficient supercharging operation by the supercharger 44 is realized. In this case, the air from the intake ports 20*a* and 20*b* is introduced into the cylinder bore, as shown by an arrow T, downward along the vertical inner surface of the cylinder bore, so that a transverse scavenging operation occurs and the exhaust gas is sent to the exhaust ports 22*a* and 22*b* along the direction transverse to the axis of the cylinder bore, as shown by an arrow U.

As the piston descends further, as shown in FIGS. 6A(*c*) and 6B(*c*), this introduction of the air into the cylinder bore as shown by the arrow T is promoted and a part of this air is sent to the exhaust ports 22*a* and 22*b*, as shown by an arrow V, and temporarily held therein, because the exhaust ports 22*a* and 22*b* temporarily hold a vacuum pressure created by a vacuum component in the pulsative pressure caused by the strong blow-down. This temporarily held air is re-introduced into the cylinder bore, as shown by arrow W in FIGS. 6A(*d*) and 6B(*d*), and a swirl motion is generated therein as shown by an arrow X when a positive pressure is restored in the exhaust ports 22*a* and 22*b*. As a result, a turbulence is generated to promote a propagation of the flame after ignition. At the position of the piston as shown in FIGS. 6A(*e*) and 6B(*e*), the intake valves 24*a* and 24*b* are fully closed to prevent a flow back of the newly introduced air.

Figure 7:
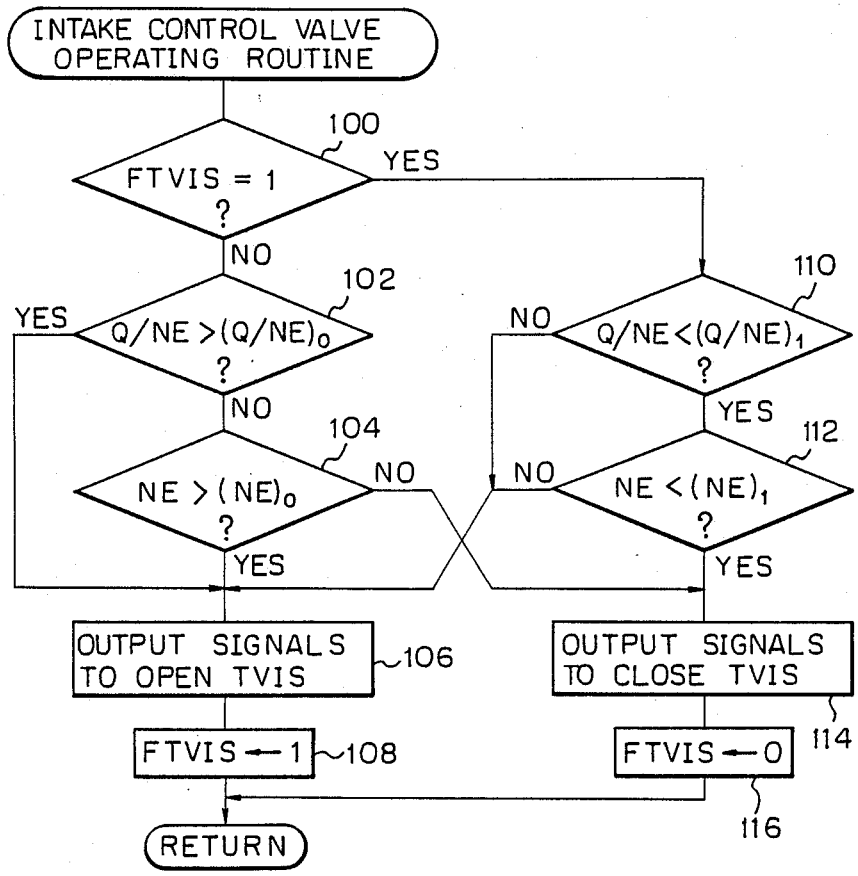
FIGS. 7 and 8, 8A and 8B, are flowcharts illustrating operations realized by a control circuit in FIG. 1.

The operation of the control circuit 60 for controlling the intake control valve 36 will be explained with reference to the flowchart of FIG. 7. This routine can be executed at a predetermined time interval. At step 100, it is determined if a flag FTVIS is 1. When FTVIS =0, the routine goes to step 102 where it is determined if the value of the ratio of the intake air amount to the engine speed Q/Ne is larger than a predetermined threshold value $(Q/NE)_0$. Then, at step 104, it is determined if the engine speed NE is larger than a predetermined threshold value $(NE)_0$. When $Q/NE > (Q/NE)_0$ or $NE > (NE)_0$, the routine goes to step 106, where a signal is issued from the output port 60-4 to the actuator 37 so that the intake control valve 36 is opened. At the following step 108, the flag FTVIS is set (1). When FTVIS=1 at step 100, the routine goes to step 110 where it is determined if the value of the ratio of the intake air amount to the engine speed, Q/Ne is smaller than a predetermined threshold value $(Q/NE)_1$. Then, at step 112, it is determined if the engine speed NE is smaller than a predetermined threshold value $(NE)_1$. When $Q/NE < (Q/NE)_1$ and $NE < (NE)_1$, the routine goes to step 114, where a signal is issued from the output port 60-4 to the actuator 37 so that the intake control valve 36 is closed. Then, at step 116, the flag FTVIS is reset (0).

Now the principle of the fuel injection operation of the present invention will be described. As in the known fuel injection system for a usual four stroke internal combustion engine, the present invention fuel injection system for a two stroke engine employs a basic concept that an amount of introduced air is measured and the amount of fuel to be injected is determined in accordance with the detected air amount in order to obtain a desired air-fuel ratio. In the two stroke engine having conventional piston valve type intake and exhaust valves, or the type of engine in which a very long overlap period occurs during which both the intake and exhaust valves are opened, allowing a large amount of newly introduced air to be blown out to the exhaust system before combustion, the ratio of the blown out air to the amount of total introduced air is varied in accordance with engine basic conditions, including the engine load and engine speed. It has, therefore, been proposed to correct the amount of fuel to be injected in accordance with the blown out ratio calculated from a predetermined algebraic function, such as an exponential function. See Japanese Unexamined Patent Publication No. 53-27731. But this prior art can not provide a precise correction when applied to a two stroke engine with such intake and exhaust valves, because of a complicated influence of the exhaust gas blow-down on the characteristic of blown out air, i.e., a mere exponential function is insufficient to attain a precise correction of the injected fuel amount. Furthermore, the provision of the intake control valve 36 causes a non-continuous change of the air blowing out ratio at a transition point where the intake control valve is moved between the opened and the closed condition. Such a non-continuous change in the blowing out ratio makes it difficult to precisely correct the air-fuel ratio by the mere employment of an algebraic function. Therefore, according to the present invention, data of the captured air ratio, which corresponds to the ratio of the air captured in the cylinder to the total amount of air introduced, is stored in the memory 60-2 in accordance with the engine operating conditions, then, during the actual operation of the engine, an interpolation calculation is carried out to obtain a value of an actual captured air ratio, and finally, the injected fuel amount is corrected in accordance with the calculated actual captured air ratio, so that a desired air-fuel ratio is obtained regardless of the complex manner in which the blowing out ratio of the intake air is varied in accordance with the engine operating conditions.

Figures 8, 8A:
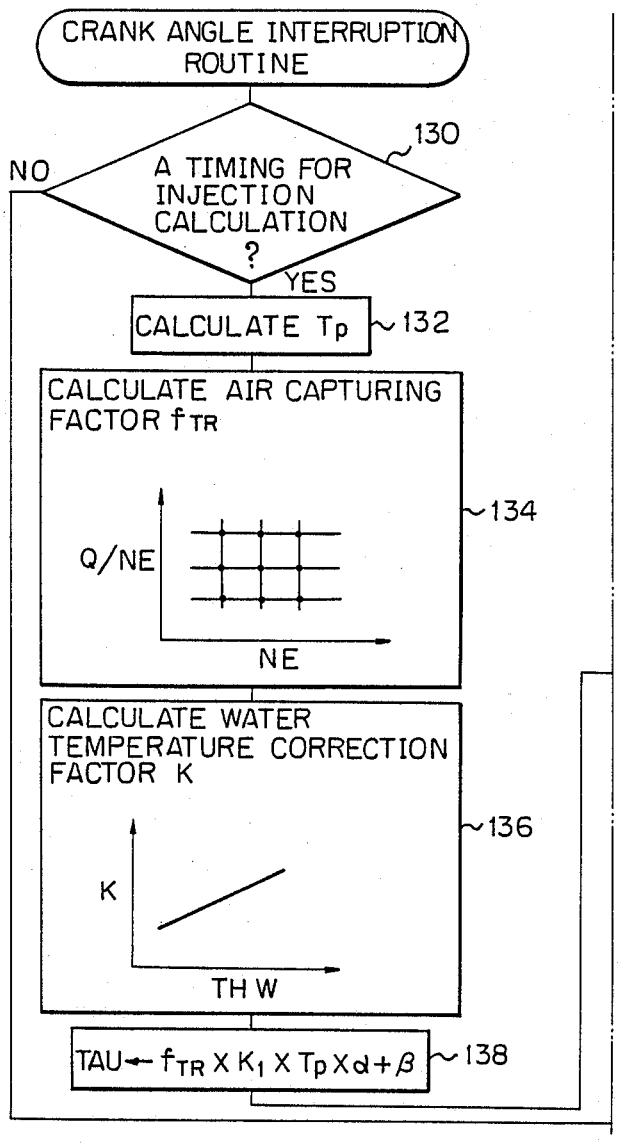
Figure 8B:
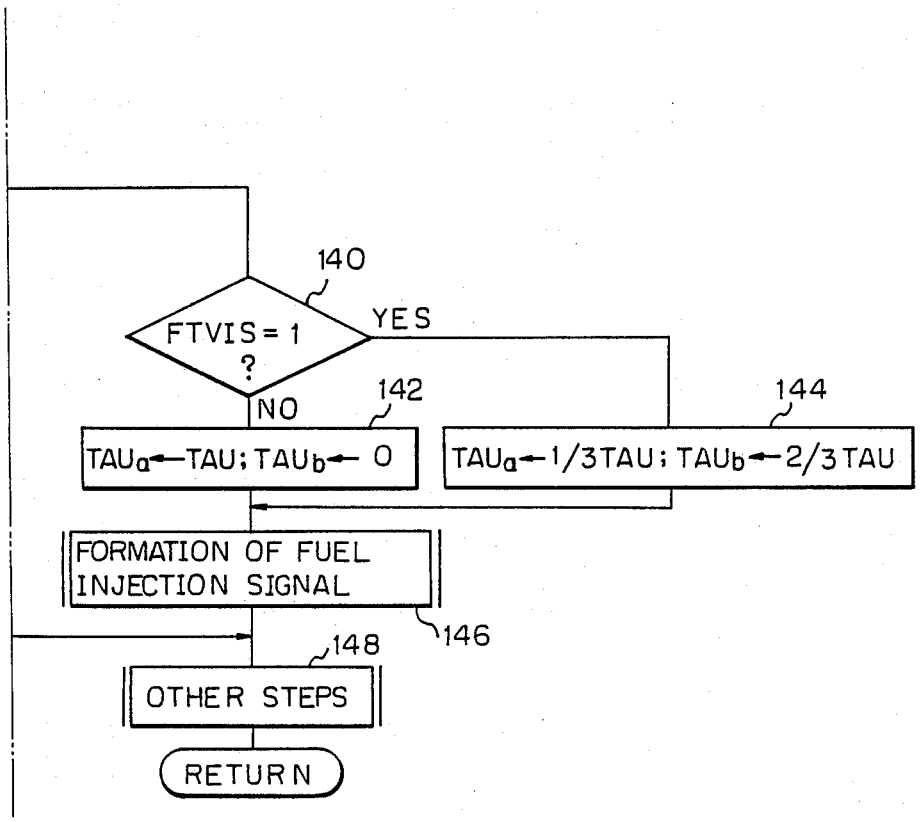
Figure 9:
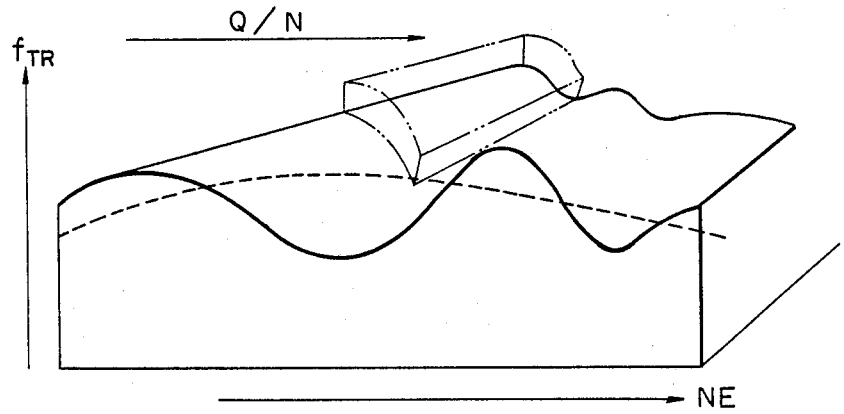
FIG. 9 schematically illustrates a change in the captured air ratio in accordance with Q/NE and NE; and, FIGS. 10, 10A, 10B, 11, 11A, 11B, 12, 12A, 12B, 13, 13A, 13B, 14A and 14B are flowcharts illustrating the fuel injection routines for other embodiments of the present invention.

FIG. 8 shows a routine for carrying out a fuel injection, which routine is executed upon every receipt of a pulse signal from the second crank angle sensor 64 at every 30 degrees of crank angle. At step 130, it is determined if this interruption timing is for the calculation of an injected fuel amount. As shown in FIG. 3, the fuel injection is carried out at a predetermined crank angle area I at which the intake valves 24*a* and 24*b* are open. Therefore, the fuel injection calculation routine in FIG. 8 is executed at a 30 degrees crank angle timing before the fuel injection period I. This 30 degrees crank angle timing is detected by obtaining a value of counter which is cleared for every pulse signal at an interval of 360 degrees of crank angle, from the first crank angle sensor 62, and incremented for every 30 degrees crank angle signal from the second crank angle sensor 64. When it is determined that this is the fuel injection calculation timing, at step 130, the routine goes to step 132, where a basic fuel injection amount $T_p$ is calculated by $$T_p = k \times (Q'/NE),$$

where Q' denotes an amount of intake air (mass) which is a volumetric intake air amount Q measured by the air-flow sensor 48 and corrected by the temperature of the intake air. In the system where the fuel injection amount is calculated by an intake pressure PM, instead of measuring Q'/NE, a value of PM can be employed. At step 134, a map interpolation calculation of a new captured air factor $f_{TR}$ is calculated. The captured air factor $f_{TR}$, which is used to correct the calculated fuel injection amount, corresponds to a ratio to the total amount of intake air as introduced of the amount of air actually utilized for combustion in the cylinder bore, which is the total intake air amount subtracted by the air blown out to the exhaust system before combustion. FIG. 9 schematically illustrates how this captured air ratio $f_{TR}$ is varied in accordance with the ratio of the intake air to the engine speed, Q/NE, and the engine speed NE. As will be very clear, because of the pulsative change in the exhaust pressure caused by the blow-down, there is a relatively complicated change in the value of the captured air ratio $f_{TR}$ in accordance with the ratio of the intake air to the engine speed, Q/NE, and the engine speed NE. It should be noted that, in FIG. 9, a dotted line is a characteristic of no affect by the blow-down. It also will be seen that there is a non-continuous change, as shown by a phantom line in the value of the captured air coefficient $f_{TR}$ at the transient area where the intake control valve 36 is switched between a closed position and an opened position. The memory 60-2 is provided with a data map obtained from the values of the captured air coefficient $f_{TR}$ with respect to combinations of the values of the ratio of the intake air amount to the engine speed, Q/NE and the values of the engine speed, which correspond to the curve in FIG. 9. A map interpolation calculation is carried out to calculate a value of the captured air factor $f_{TR}$ corresponding to a detected combination of a value of Q/NE and a value of NE. In the system where the fuel injection amount is calculated by an intake air pressure PM instead of an intake amount Q, it should be noted that a map of values of the captured air ratio $f_{TR}$ is provided with respect to combinations of values of the PM and the engine speed NE, and a map interpolation is carried out to obtain a value of the captured air ratio $f_{TR}$ from the actual value of the intake pressure measured by the pressure sensor 61. It should be further noted that, instead of calculating the captured air factor $f_{TR}$ which is multiplied by the basic fuel injection amount, the detected intake air amount Q is first corrected by the captured air factor $f_{TR}$, and then the basic fuel injection amount is calculated from the corrected intake air amount Q.

At step 136, an engine water temperature correction factor $K_1$ is calculated. This factor $K_1$ is used to correct the influence of the water temperature on the blown out air. As the engine temperature drops, the exhaust pressure also drops, causing the air to be easily blown-out. Therefore, the value of the factor $K_1$ is reduced as the temperature of the engine cooling water falls, in order to maintain the desired air-fuel ratio irrespective of the water temperature. The memory 60-2 is provided with a data map of the value of factor $K_1$ and engine cooling water temperature THW, and a map interpolation is carried out to calculate a value of the engine cooling water correction factor $K_1$ corresponding to an actual engine cooling water temperature THW measured by the sensor 68. At step 138, a value of the final fuel injection amount TAU is calculated by $$TAU = f_{TR} \times K_1 \times T_p \times \alpha + \beta,$$

where $\alpha$ and $\beta$ generally designate a correction factor and a correction amount, respectively, which since they are not directly related to the present invention, will not be explained herein.

At step 140, it is determined if the flag FTVIS is l, i.e., the intake control valve 36 is opened or closed. When the intake control valve 36 is closed, the routine goes to step 142, where a value of TAU is moved to a memory area TAUa for storing the data of the fuel injection period for the first injector 38*a*, and zero is moved to a memory area TAUb for storing the data of the fuel injection period for the second injector 38*b*. Accordingly, the second injector 38*b* is non-operative when the intake control valve 36 is closed.

When it is determined that the intake control valve 36 is opened at step 140, the routine goes to step 144, where a valve of $\frac{1}{3}$ TAU is moved to a memory area TAUa for storing the data of the fuel injection period for the first injector 38*a*, and a remaining valvue of $\frac{2}{3}$ is moved to a memory area TAUb for storing the data of the fuel injection period for the second injector 38*b*. These values $\frac{1}{3}$ and $\frac{2}{3}$ are only by way of example, and are suitably determined so that the same air-fuel ratio can be obtained at both of the intake passageways 34*a* and 34*b* having a different effective area. At the following step 146, fuel injection signals are formed, as well known, so that the injectors 38*a* and 38*b* are operated to inject the calculated fuel amounts TAUa and TAUb. Step 148 generally shows other steps not related to this invention and executed at every 30 degrees crank angle signal.

FIG. 10 shows a flowchart of a fuel injection routine in a second embodiment of the present invention. This embodiment differs from the first embodiment only in steps 236 and 238, and therefore, an explanation of the other steps will be omitted, and the number 100 will be added to the number of the respective steps in FIG. 8. Instead of calculating a correction factor in accordance with engine cooling water temperature as in step 136 of FIG. 8 in the first embodiment, at step 236 in FIG. 9, a correction factor $K_2$ is calculated in accordance with an outside air temperature THA. The atmospheric air temperature, similar to the engine cooling water temperature, indicates the exhaust gas pressure which affects the air blown out characteristics. As the outside temperature decreases, the exhaust gas pressure decreases, causing an increase in the amount of blown out air. Therefore, in this embodiment, a correction factor $K_2$, the value of which decreases as the atmospheric air temperature THA decreases, is multiplied by the captured air factor $f_{FR}$ to obtain a precise air fuel ratio irrespective any change in the captured air factor. As in the first embodiment, the memory is provided with a map of the values of the correction factor $K_2$ and the atmospheric air temperature, and a map interpolation calculation is carried out to obtain a value of an atmospheric air temperature correction factor $K_2$ corresponding to a detected actual value of the atmospheric air temperature THA. Note, a sensor 69 is arranged in the intake line near the air cleaner 50 for detecting the actual temperature of the outside air as shown in FIG. 1. At step 239, the final fuel injection amount is obtained by the equation:

$$TAU = f_{TR} \times K_2 \times T_p \times \alpha + \beta,$$

which is the same as the equation in step 138 in the first embodiment except that $K_2$ replaces $K_1$.

Figures 11, 11A:
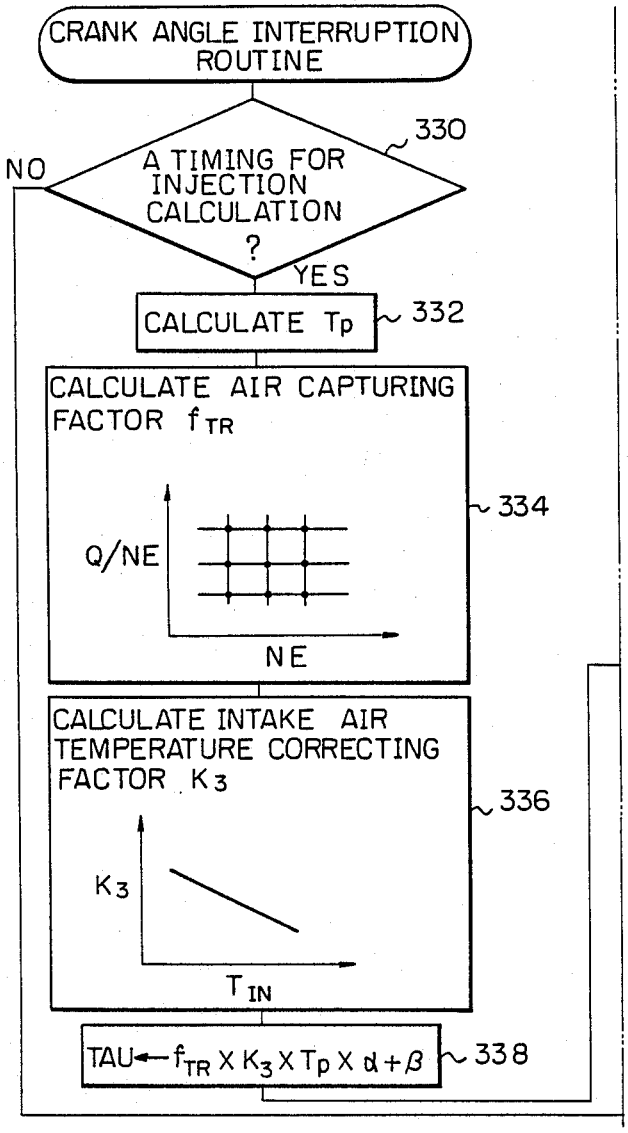
Figure 11B:
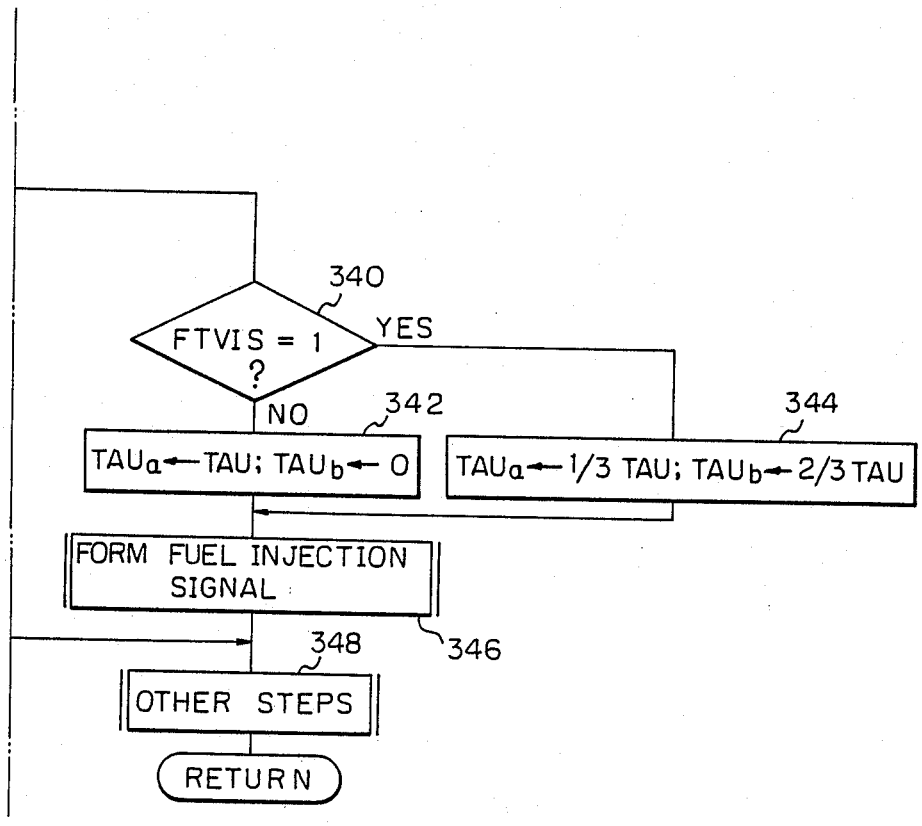

In the third embodiment of the present invention, a correction of the captured air factor is made in accordance with the temperature of the air introduced into the combustion chamber 17. As the temperature of the air introduced into the engine rises, the pressure of the introduced air is increased, causing the air in the cylinder bore to be easily blown out. Therefore, there is a change in captured air ratio in accordance with the pressure of the air introduced into the cylinder bore, and this must be corrected to obtain a precise air-fuel ratio. FIG. 11 shows a flow chart of a fuel injection routine. This routine differs from the routine in FIG. 8 only in steps 336 and 338, and therefore, a detailed explanation of the other steps is omitted and the number 200 is added to the number of the respective steps in FIG. 8. As in the first embodiment, the memory is provided with a map of the values of the correction factor $K_3$ and intake air temperature $T_{IN}$. At step 336, a map interpolation calculation is carried out to obtain a value of the intake air temperature correction factor $K_3$ corresponding to a detected actual value of the temperature of the intake air. Note, a sensor 70 is arranged in the intake line downstream of the supercharger 42 for detecting the actual temperature of the intake air introduced into the cylinder bore, as shown in FIG. 1. At block 338, the final fuel injection amount is obtained by the equation:

$$TAU=f_{TR}\times K_3\times T_p\times\alpha+\beta,$$

which is the same as the equation in step 138 in the first embodiment except that $K_3$ replaces $K_1$.

Figures 12, 12A:
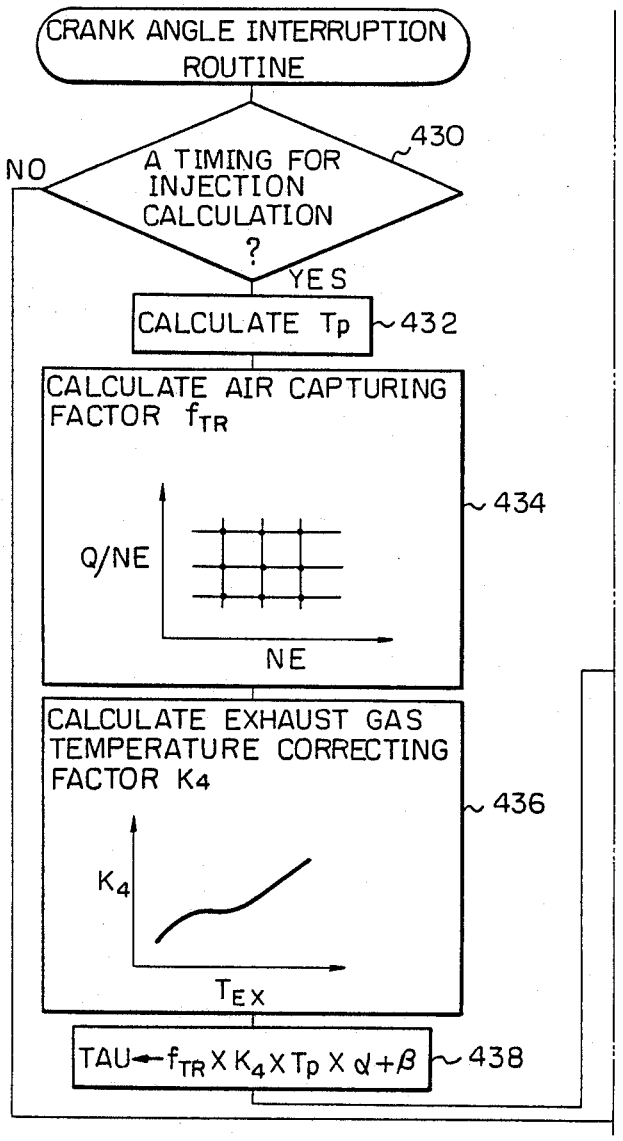
Figure 12B:
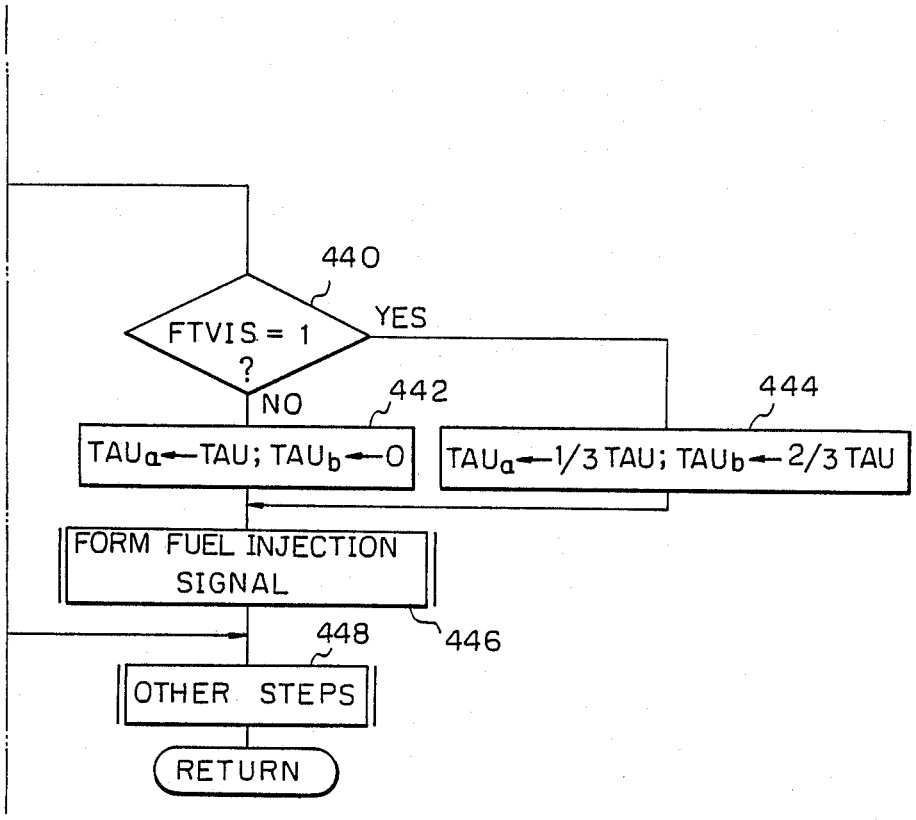

In the fourth embodiment of the present invention, a temperature of the exhaust gas is measured to compensate for the change in the amount of air blown out in accordance with the pressure of the exhaust gas. As will be easily understood, the amount of air blown out is increased in accordance with an increase in the temperature of the exhaust gas, which is proportional to the exhaust gas pressure. FIG. 12 shows a flow chart of the fuel injection routine. This routine differs from the routine in FIG. 8 only in steps 436 and 438, and therefore, an explanation of the other steps is omitted and the number 300 is added to the numbers of the corresponding steps in FIG. 8. As in the first embodiment, the memory is provided with a map of the values of the correction factor $K_4$ and the temperature of the exhaust gas $T_{EX}$. At step 436, a map interpolation calculation is carried out to obtain a value of the exhaust temperature correction factor $K_4$ corresponding to a detected actual value of the temperature of the exhaust gas $T_{EX}$. Note, a sensor 72 is arranged in the exhaust line near the combustion chamber for detecting the actual temperature of the exhaust gas from the combustion chambers, as shown in FIG. 1. At step 438, the final fuel injection amount is obtained by the equation:

$$TAU=f_{TR}\times K_4\times T_p\times\alpha+\beta$$

which is the same as the equation in step 138 in the first embodiment except that $K_4$ replaces $K_1$.

Figures 13, 13A:
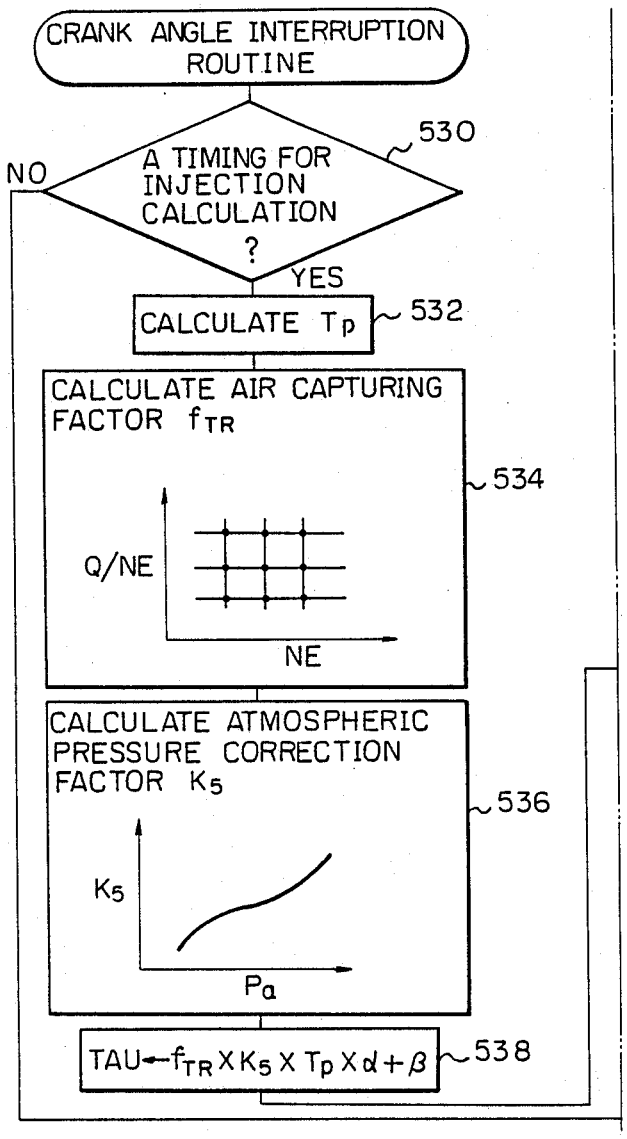
Figure 13B:
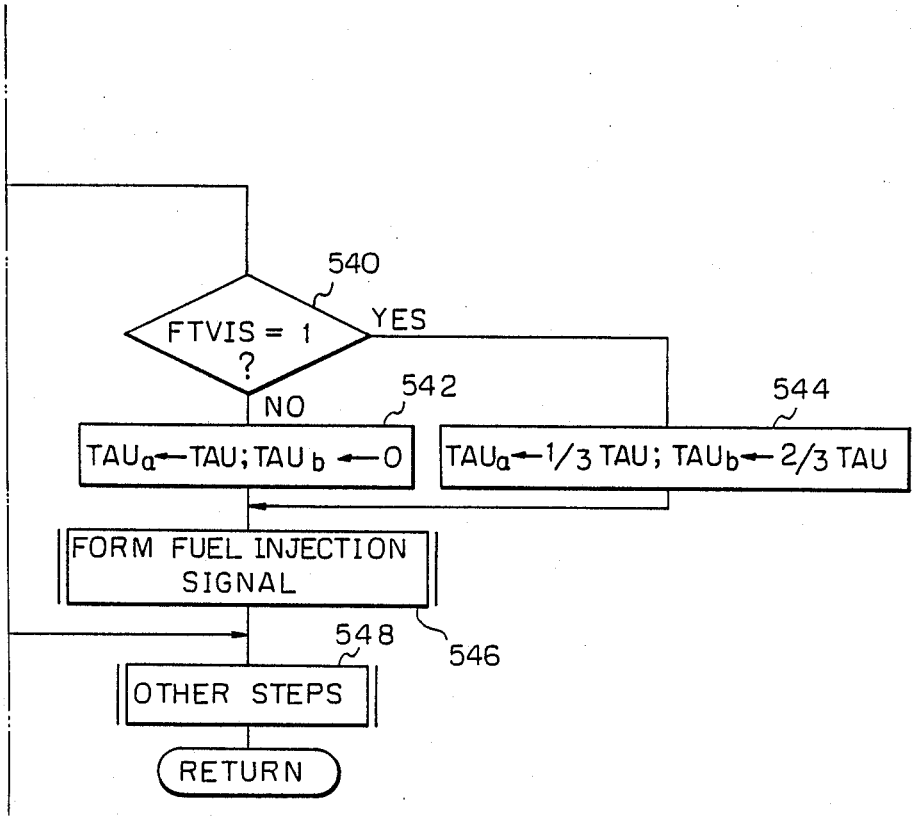

In the fifth embodiment of the present invention, the atmospheric air pressure is measured to compensate for the captured air factor. The atmospheric air pressure is decreased when the vehicle is running in a high altitude location. The decrease in the atmospheric pressure causes a decrease in the exhaust pressure, so that a blow out of newly introduced air to the exhaust port easily occurs. To compensate for the change in the blown out air factor in accordance with the atmospheric pressure, a correction factor $K_5$, the value of which is increased in accordance with the increase in the atmospheric pressure, is introduced. The correction factor $K_5$ is multiplied by the captured air factor $f_{TR}$ to compensate the captured air factor. FIG. 13 shows a flow chart of a fuel injection routine. This routine differs from the routine in FIG. 8 only in steps 536 and 538, and therefore an explanation of the other steps is omitted and 400 is added to the member of the corresponding steps in FIG. 8. As in the first embodiment, the memory is provided with a map of the values of the correction factor $K_5$ and the atmospheric air pressure Pa. At step 536, a map interpolation calculation is carried out to obtain a value of the atmospheric pressure correction factor $K_5$ corresponding to a detected actual value of the atmospheric pressure Pa. Note, a sensor 74 is arranged appropriately in the engine room for detecting the actual atmospheric pressure, as shown in FIG. 1. At step 538, the final fuel injection amount is obtained by the equation:

$$TAU=f_{TR}\times K_5\times T_p\times\alpha+\beta$$

which is the same as the equation in step 138 in the first embodiment except that $K_5$ replaces $K_1$.

Figures 14, 14A:
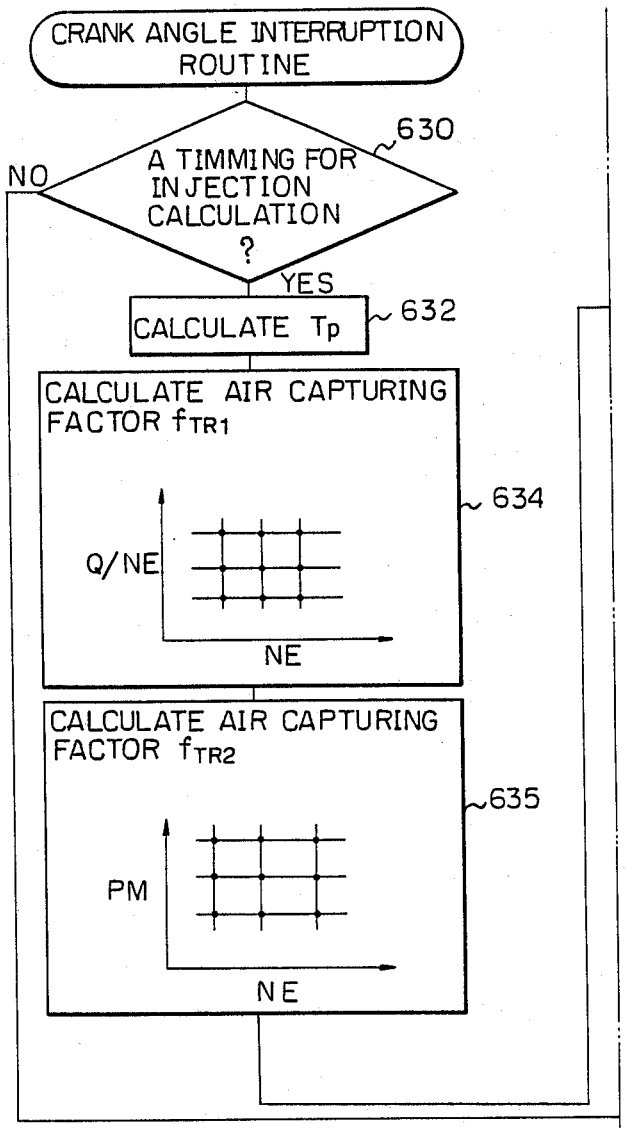
Figure 14B:
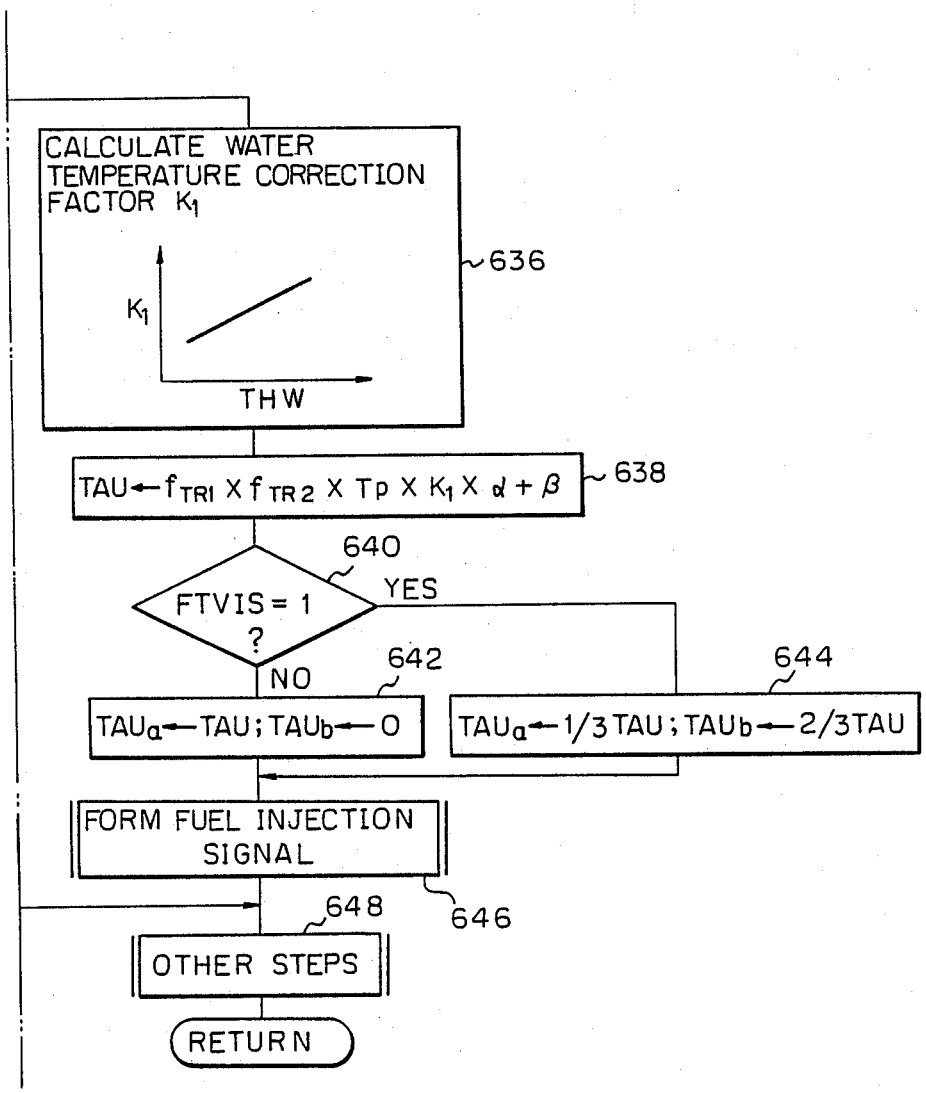

FIG. 14 shows a fuel injection routine in another embodiment, which is a modification of the embodiment of FIG. 1. In this embodiment, in addition to the calculation of the captured air ratio by the ratio of the intake air amount to the engine speed, a calculation of the captured air ratio is carried out in accordance with the intake air pressure. Usually both the air amount to engine speed ratio Q/NE and the intake pressure PM are considered to represent the engine load parameter. There is, however, a slight non-linearity between the intake air pressure PM and the air amount to engine speed ratio Q/NE. Therefore, a precise detection of the captured air ratio cannot be realized if calculated on the basis of Q/NE or PM. When the captured air ratio is calculated on the basis of Q/NE as in the preceding embodiments, the actual captured air ratio is affected by the intake pressure PM. When the intake pressure is, for example, high, the amount of blown out air is large so that the actual captured air ratio will be larger than that calculated only from Q/NE. According to this embodiment, to obtain a precise captured air amount, the captured air ratio is calculated both from the Q/NE and the PM. The flow chart in FIG. 14 is different from FIG. 8 in that a step 635 is added after step 634 corresponding to step 134 in FIG. 8 and step 636 is modified. Therefore an explanation of the other steps will be omitted and 500 added to the numbers of corresponding steps in FIG. 8. At step 635, a map interpolation calculation of a new captured air coefficient $f_{TR2}$ is calculated. The captured air coefficient $f_{TR2}$, as in the first factor $f_{TR1}$, is a factor for correcting the calculated fuel injection amount mean ratio to the total amount of intake air as introduced, of the amount of air actually combusted in the cylinder bore, which is the total intake air amount less the air blown out to the exhaust system before combustion. The memory 60-2 is provided with a data map obtained from the values of second captured air coefficient $f_{TR2}$ with respect to combinations of the values of the ratio of the intake pressure PM and the values of the engine speed. A map interpolation calculation is carried out to calculate a value of the captured air factor $f_{TR2}$ corresponding to a detected combination of a PM value and an NE value. At step 638, the final fuel injection amount is obtained by the equation;

$$TAU=f_{TR1}\times f_{TR2}\times T_p\times K_1\times\alpha+\beta,$$

which is the same as the equation in tep 138 in the first embodiment except that $f_{TR1}$ is added as a multiplier.

Although the present invention described with reference to the above embodiments, many modifications and changes may be made by those skilled in this art without departing from the scope and spirit of the present invention.

We claim:

1. An internal combustion engine comprising:

an engine body;

an intake system connected to the engine body for an introduction of air thereto;

an exhaust system connected to the engine body for a removal of a resultant exhaust gas;

means for supplying a desired amount of fuel to the engine;

means for calculating said desired amount of fuel in accordance with basic engine operating conditions including an map means for storing data of a parameter for a compensation of the amount of air to be blown out, said map means comprising a plurality of values of said parameter, each value being determined by a combination of at least an engine load and engine speed;

means for reading a value of said parameter from said map means corresponding to a combination of an engine load and engine Speed;

means for correcting the calculated fuel amount by incorporating the calculated parameter, and;

means for generating a signal directed to the fuel supply means for introduction of a corrected amount of fuel into the engine.

2. An internal combustion engine according to claim 1, further comprising second correcting means for further correcting the calculated amount of fuel in accordance with a secondary engine operating condition other than the engine load and speed which affects the blowing out of air introduced into the engine.

3. An internal combustion engine according to claim 2, wherein said second correcting means comprise sensor means for detecting a value of said secondary engine operating condition, means for storing data of second parameter related to an amount of blown out air in accordance with the value of the secondary engine operating condition, means for reading a value of a second parameter from said data storing means corresponding to the detected secondary engine operating condition, and correcting means for the calculates fuel amount of air by incorporating the second parameter.

4. An internal combustion engine according to claim 2, wherein said secondary operating condition is an engine cooling water temperature.

5. An internal combustion engine according to claim 2, wherein said secondary operating condition is an atmospheric air temperature.

6. An internal combustion engine according to claim 2, wherein said secondary operating condition is an intake air temperature.

7. An internal combustion engine according to claim 2, wherein said secondary operating condition is an exhaust gas temperature.

8. An internal combustion engine according to claim 2, wherein said secondary operating condition is an atmospheric air pressure.

9. An internal combustion engine according to claim 2, wherein said second correcting means comprise sensor means for detecting a value of said secondary engine operating condition, means for storing data of second parameter related to an amount of blown out air in accordance with combinations of a value of said secondary operating condition and an engine speed, means for reading a value of a second parameter from data storing means corresponding to the detected secondary operating condition and an engine speed, and correcting means for correcting the basic calculated fuel amount by incorporating the second parameter.

10. An internal combustion engine according to claim 9, wherein said secondary operating condition is an intake pressure.

11. An internal combustion engine according to claim 1, wherein said internal combustion engine is two stroke engine with intake and exhaust valves.

12. An internal combustion engine according to claim 11, further comprising a supercharger arranged in the intake system.

13. A two stroke type internal combustion engine comprising:

an engine body having cylinders, each of which is provided with intake and exhaust valves;

an intake system connected to the engine body for an introduction of air thereto;

a supercharger arranged in the intake system;

means for kinematically connecting the supercharger to the engine body for operation thereof;

an exhaust system connected to the engine body for removal of a resultant exhaust gas;

means for supplying a desired amount of fuel to the engine;

means for calculating said desired amount of fuel in accordance with engine operating conditions including an engine load and engine speed;

map means for storing data of a parameter for a compensation of the amount of air to be blown out, said map means comprising a plurality of values of a parameter, each value being determined by a combination of an engine load and engine speed;

means for reading a value of a parameter from said map means corresponding to a combination of an engine load and engine speed;

means for correcting the calculated fuel amount by incorporating the calculated parameter;

second correcting means for further correcting the calculated amount of fuel in accordance with a secondary operating condition other than the engine load and engine speed, which also affects the blowing out of air introduced into the engine, and;

means for generating a signal directed to the fuel supply means for an introduction of a corrected amount of fuel into the engine.

14. An internal combustion engine according to claim 13, wherein said secondary operating condition is an engine cooling water temperature.

15. An internal combustion engine according to claim 13, wherein said secondary operating condition is an atmospheric air temperature.

16. An internal combustion engine according to claim 13, wherein said secondary operating condition is an intake air temperature.

17. An internal combustion engine according to claim 13, wherein said secondary operating condition is an exhaust gas temperature.

18. An internal combustion engine according to claim 13, wherein said secondary operating condition is an atmospheric air pressure.

19. An internal combustion engine according to claim 13, further comprising second correcting means for further correcting the calculated amount of fuel in accordance with a secondary engine operating condition other than the engine load and speed which affects the blowing out of air introduced into the engine.

20. An internal combustion engine according to claim 19, wherein said second correcting means comprise sensor means for detecting an intake pressure, means for storing data of a second parameter related to an amount of blown out air in accordance with combinations of a value of said intake pressure and engine speed, means for reading a value of a second parameter from data storing means corresponding to the detected intake pressure and engine speed, and correcting means for correcting the calculated fuel amount by incorporating the calculated second parameter.

* * * * *